US011273946B2

(12) United States Patent
Sugizaki et al.

(10) Patent No.: US 11,273,946 B2
(45) Date of Patent: Mar. 15, 2022

(54) BOTTLE IN WHICH DEFORMATION OF A BODY PORTION AT THE TIME OF PRESSURE REDUCTION CAN BE INHIBITED

(71) Applicant: YOSHINO KOGYOSHO CO., LTD., Tokyo (JP)

(72) Inventors: Takumi Sugizaki, Tokyo (JP); Hiroki Oguchi, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 50 days.

(21) Appl. No.: 16/449,587

(22) Filed: Jun. 24, 2019

(65) Prior Publication Data

US 2020/0002044 A1 Jan. 2, 2020

(30) Foreign Application Priority Data

Jun. 29, 2018 (JP) ..... JP2018-123818

(51) Int. Cl.
*B65D 1/02* (2006.01)
*B65D 23/10* (2006.01)

(52) U.S. Cl.
CPC ..... *B65D 1/0223* (2013.01); *B65D 23/102* (2013.01); *B65D 2501/0036* (2013.01); *B65D 2501/0081* (2013.01)

(58) Field of Classification Search
CPC ..... B65D 1/0223; B65D 23/00; B65D 2501/0081; B65D 1/0284; B65D 23/102; B65D 2501/0036; B65D 1/04; B65D 1/40; B65D 1/0207
USPC ..... 215/379; 515/383
See application file for complete search history.

(56) References Cited

U.S. PATENT DOCUMENTS 4,464,316 A * 8/1984 Michaels ..... B65D 41/0471 128/200.11
10,513,363 B2 * 12/2019 Kira ..... B65D 1/02
2006/0151425 A1 * 7/2006 Kelley ..... B65D 1/0223 215/381
2006/0186083 A1 * 8/2006 Joshi ..... B65D 1/0223 215/381
2007/0187354 A1 * 8/2007 Sasaki ..... B65D 79/005 215/384

(Continued)

FOREIGN PATENT DOCUMENTS

JP 5598037 B2 10/2014
WO WO-2014087866 A1 * 6/2014 ..... B65D 1/02
WO WO-2015076362 A1 * 5/2015 ..... B65D 1/0223

*Primary Examiner* — Rafael A Ortiz
*Assistant Examiner* — Sanjidul Islam
(74) *Attorney, Agent, or Firm* — Oliff PLC

(57) ABSTRACT

A square bottle that includes a mouth portion, a shoulder portion, a body portion, and a bottom portion provided to be continuous in this order from the top to the bottom in a bottle axis direction, wherein in the body portion a plurality of panel surface portions are provided to be continuous with each other with corner portions therebetween in a circumferential direction around a bottle axis and in the body portion a first peripheral groove straddling at least the corner portions in the circumferential direction is formed, and a ridge portion straddling the corner portions in the circumferential direction is formed on an inner surface defining the first peripheral groove.

6 Claims, 2 Drawing Sheets

(56) References Cited

U.S. PATENT DOCUMENTS

2008/0223816 A1* 9/2008 Darr ..... B65D 1/0223
215/382

* cited by examiner

BOTTLE IN WHICH DEFORMATION OF A BODY PORTION AT THE TIME OF PRESSURE REDUCTION CAN BE INHIBITED

CROSS-REFERENCE TO RELATED APPLICATIONS

The present application claims priority to Japanese Patent Application No. 2018-123818, filed Jun. 29, 2018, the content of which is incorporated herein by reference.

BACKGROUND OF THE INVENTION

Field of the Invention

The present invention relates to a square bottle.

Description of Related Art

Conventionally, for example, a square bottle in which a mouth portion, a shoulder portion, a body portion, and a bottom portion are provided to be continuous in this order from the top to the bottom in a bottle axis direction, the body portion is configured such that a plurality of panel surface portions are provided to be continuous with each other with a corner portion therebetween in a circumferential direction around the bottle axis, and a first peripheral groove is formed in the body portion, is known as described in Japanese Patent No. 5598037

SUMMARY OF INVENTION

However, in a conventional square bottle, when a body portion is made thin for weight reduction, there is a problem in that the body portion tends to be deformed such as an internal angle of a corner portion changing at the time of pressure reduction in the square bottle.

The present invention has been made in consideration of such circumstances and an objective of the present invention is to provide a square bottle in which deformation of a body portion at the time of pressure reduction in the square bottle can be inhibited even when the body portion is made thin.

In order to solve the above-described problems and achieve the objective, as a first aspect of the present invention, a square bottle including a mouth portion, a shoulder portion, a body portion, and a bottom portion are provided to be continuous in this order from the top to the bottom in a bottle axis direction, in which in the body portion a plurality of panel surface portions are provided to be continuous with each other with corner portions therebetween in a circumferential direction around a bottle axis and in the body portion a first peripheral groove straddling at least the corner portions in the circumferential direction is formed, and a ridge portion straddling the corner portions in the circumferential direction is formed on an inner surface defining the first peripheral groove.

According to the present invention, since the ridge portion straddling the corner portions in the circumferential direction is formed on the inner surface of the first peripheral groove, a rigidity of the corner portions can be increased and deformation of the body portion such as internal angles of the corner portions changing at the time of pressure reduction in the square bottle can be inhibited even when the body portion is made thin.

Here, as a second aspect, in the square bottle of the first aspect, a second peripheral groove straddling at least the corner portions in the circumferential direction may be formed in the body portion, and the first peripheral groove may be formed on an inner surface defining the second peripheral groove.

In this case, since the first peripheral groove is formed on an inner surface of the second peripheral groove formed in the body portion, a rigidity of the entire body portion is increased and deformation of the body portion at the time of pressure reduction in the square bottle can be reliably inhibited even when the body portion is made thin.

Also, as a third aspect, in the square bottle of the first aspect or the second aspect, the body portion may have a rectangular shape in a cross-sectional view perpendicular to the bottle axis and in the body portion the panel surface portion on the long side and the panel surface portion on the short side may be provided to be continuous with each other via the corner portion.

In this case, although the body portion has a rectangular shape in a cross-sectional view perpendicular to the bottle axis and the body portion is likely to be deformed in such a manner that internal angles of the two corner portions facing each other in the radial direction are widened and the remaining two corner portions are narrowed at the time of pressure reduction in the square bottle, since deformation of the body portion can be inhibited due to the ridge portion formed on the inner surface of the first peripheral groove, significant operational effects are achieved.

Also, as a fourth aspect, in the square bottle of the third aspect, the ridge portion may be disposed to integrally straddle the panel surface portion on the short side and the corner portions which are continuous with both end portions in the circumferential direction of the panel surface portion on the short side in the circumferential direction and may be disposed to avoid a central portion in the circumferential direction of the panel surface portion on the long side.

In this case, since the ridge portion is disposed to integrally straddle the panel surface portion on the short side and the corner portions which are continuous with both the end portions in the circumferential direction of the panel surface portion on the short side in the circumferential direction, the rigidity of the corner portion is effectively increased and deformation of the body portion at the time of pressure reduction in the square bottle can be reliably inhibited.

Also, since the ridge portion is disposed to avoid a central portion in the circumferential direction of the panel surface portion on the long side, when the panel surface portion on the long side is gripped in order to lift the square bottle, the ridge portion can be prevented from being obstacle due to it being touched with fingers.

According to the present invention, deformation of the body portion at the time of pressure reduction in the square bottle can be inhibited even when the body portion is made thin.

DETAILED DESCRIPTION OF THE INVENTION

Hereinafter, a square bottle 1 according to one embodiment of the present invention will be described with reference to the drawings.

Figure 1:
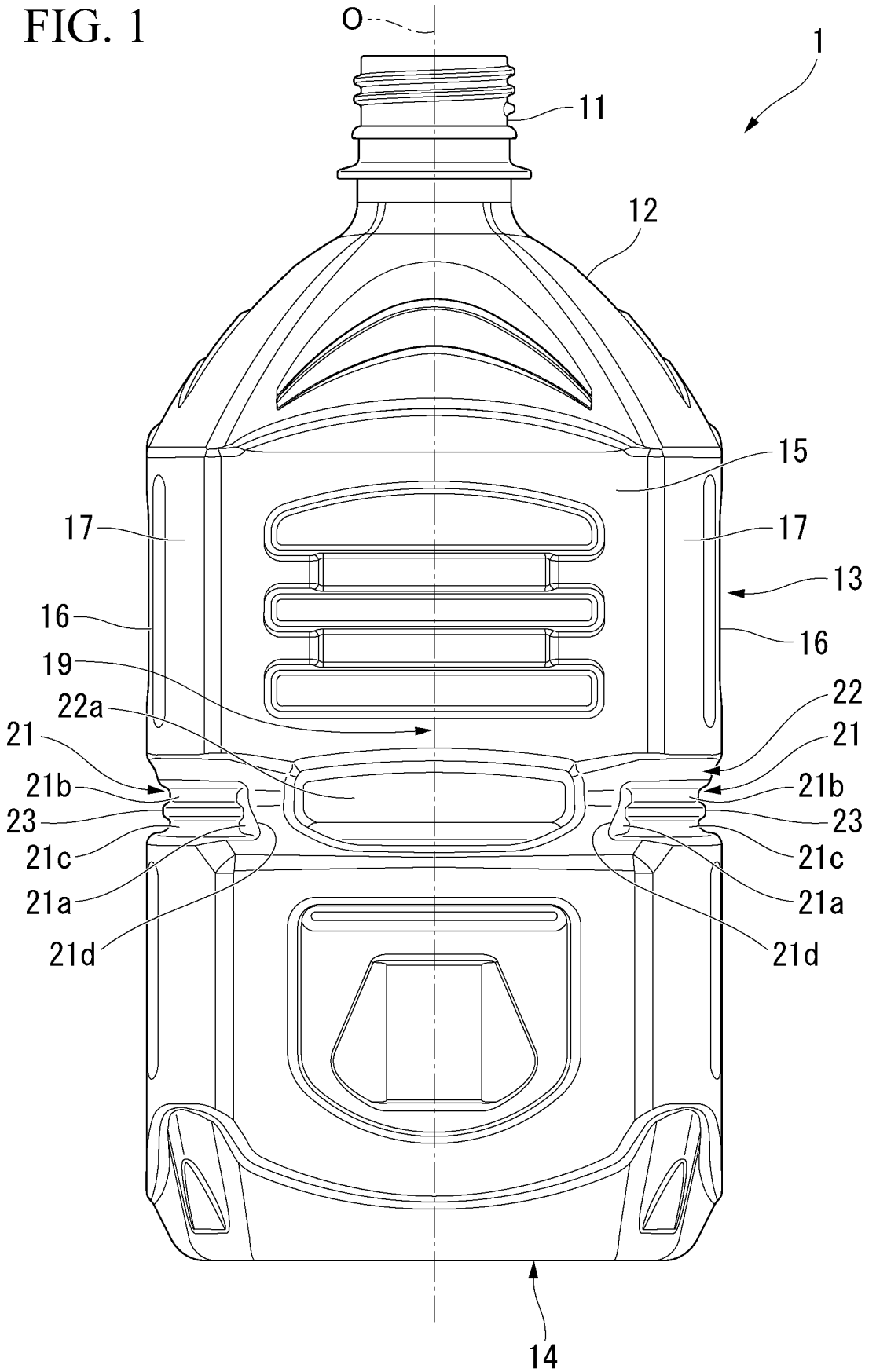
FIG. 1 is a side view of a square bottle shown as one embodiment according to the present invention when a panel surface portion on a long side is seen from the front.
Figure 2:
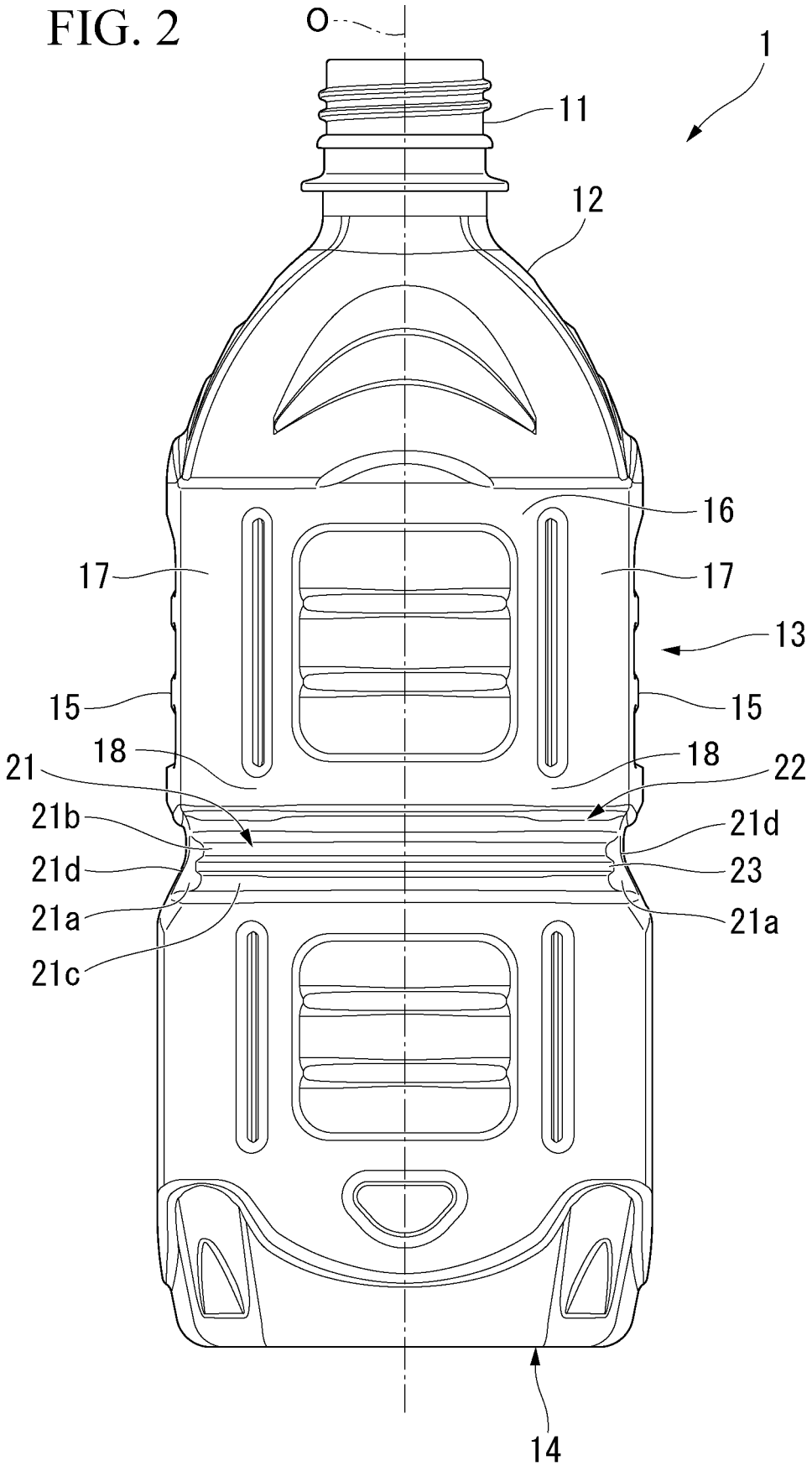
FIG. 2 is a side view of the square bottle shown in FIG. 1 when a panel surface portion on a short side is seen from the front.

As shown in FIGS. 1 and 2, the square bottle 1 is configured such that a mouth portion 11, a shoulder portion 12, a body portion 13, and a bottom portion 14 are provided to be continuous in this order from the top to the bottom in a bottle axis O direction.

Hereinafter, when viewed from a vertical direction, a direction intersecting the bottle axis O is referred to as a radial direction, and a direction of revolving around the bottle axis O is referred to as a circumferential direction.

The square bottle 1 is formed by blow molding a preform formed in a bottomed cylindrical shape by injection molding, and is integrally formed of, for example, a synthetic resin material such as polyethylene terephthalate or polypropylene. A cap (not shown) is mounted on the mouth portion 11.

An internal volume of the square bottle 1 has a size such that, for example, 200 ml or more and 4000 ml or less of contents can be filled thereinto. In the shown example, the square bottle 1 has a size such that 1000 ml of contents can be filled thereinto.

The body portion 13 is configured such that a plurality of panel surface portions 15 and 16 are provided to be continuous with each other via a corner portion 17 in the circumferential direction. That is, in the body portion 13, the plurality of panel surface portions 15 and 16 are provided to be continuous with each other via the corner portion 17 in the circumferential direction. An outer peripheral surface of each of the panel surface portions 15 and 16 extends substantially in a straight line in a cross-sectional view perpendicular to the bottle axis O. The corner portion 17 has a width in the circumferential direction and is formed in a strip shape extending in the vertical direction. Further, the corner portion 17 may be an apex angle portion having no width in the circumferential direction.

The body portion 13 has a rectangular shape in a cross-sectional view perpendicular to the bottle axis O and is configured such that a panel surface portion 15 on a long side and a panel surface portion 16 on a short side are provided to be continuous with each other via the corner portion 17. That is, in the body portion 13, the panel surface portion 15 on the long side and the panel surface portion 16 on the short side are provided to be continuous with each other via the corner portion 17. In the shown example, a length in the circumferential direction of the panel surface portion 16 on the short side is longer than half of a length in the circumferential direction of the panel surface portion 15 on the long side. The shoulder portion 12 and the bottom portion 14 also have a rectangular shape in a cross-sectional view perpendicular to the bottle axis O, similarly to the body portion 13.

A first peripheral groove 21 and a second peripheral groove 22 are formed in the body portion 13.

The second peripheral groove 22 extends continuously over the entire circumference. The second peripheral groove 22 is formed at a central portion in the vertical direction of the body portion 13. A finger rest concave portion 22*a* formed deeper than a depth of the second peripheral groove 22 is disposed at a portion of the second peripheral groove 22 positioned on the panel surface portion 15 on the long side. The finger rest concave portion 22*a* is disposed at a central portion 19 on the panel surface portion 15 on the long side.

The first peripheral groove 21 is formed at least on a bottom surface facing the outside in the radial direction in an inner surface defining the second peripheral groove 22. In the shown example, the first peripheral groove 21 is integrally formed on an upper surface facing downward, a lower surface facing upward, and the bottom surface in the inner surface defining the second peripheral groove 22. The groove width of the first peripheral groove 21 is configured to be smaller than the groove width of the second peripheral groove 22.

The first peripheral groove 21 straddles the corner portions 17 in the circumferential direction. The first peripheral groove 21 is disposed to avoid a central portion 19 in the circumferential direction of the panel surface portion 15 on the long side. In the shown example, the first peripheral groove 21 is formed over substantially the entire circumference of the bottom surface of the second peripheral groove 22 other than a portion of the finger rest concave portion 22*a*. The first peripheral groove 21 is disposed to integrally straddle the panel surface portion 16 on the short side and the corner portions 17 which are continuous with both end portions 18 in the circumferential direction of the panel surface portion 16 in the circumferential direction.

An end portion in the circumferential direction of the first peripheral groove 21 is positioned at an end portion thereof in the circumferential direction on the panel surface portion 15 on the long side. The end portion in the circumferential direction of the first peripheral groove 21 is separated from the finger rest concave portion 22*a* in the circumferential direction.

In an inner surface defining the first peripheral groove 21, a peripheral end surface 21*a* positioned at an outer end portion in the circumferential direction and facing inward in the circumferential direction gradually extends toward the inside in the circumferential direction of the first peripheral groove 21 from the outside toward the inside in the radial direction. An outer end edge 21*d* in the circumferential direction of the first peripheral groove 21 gradually extends toward the outside in the radial direction as it goes downward.

Also, in the present embodiment, a ridge portion 23 straddling the corner portions 17 in the circumferential direction is formed on the inner surface of the first peripheral groove 21.

Here, the inner surface of the first peripheral groove 21 includes an upper surface positioned at an upper end portion and facing downward, a lower surface positioned at a lower end portion and facing upward, and a bottom surface connecting the upper surface and the lower surface and facing the outside in the radial direction. Among these, the upper surface of the first peripheral groove 21 gradually extends upward as it goes toward the outside in the radial direction, and the lower surface of the first peripheral groove 21 gradually extends downward as it goes toward the outside in the radial direction.

The ridge portion 23 is formed on the bottom surface of the first peripheral groove 21. Positions in the radial direction of the bottom surface of the first peripheral groove 21 and a bottom surface of the finger rest concave portion 22*a* are the same as each other.

The ridge portion 23 is disposed over the entire circumference of the bottom surface of the first peripheral groove 21 and extends continuously. That is, the ridge portion 23 is disposed to integrally straddle the panel surface portion 16 on the short side and the corner portions 17 which are continuous with both the end portions 18 in the circumferential direction of the panel surface portion 16 in the circumferential direction and is disposed to avoid the central portion 19 in the circumferential direction of the panel surface portion 15 on the long side. Also, an end portion in the circumferential direction of the ridge portion 23 is positioned at an end portion thereof in the circumferential direction on the panel surface portion 15 on the long side.

The ridge portion 23 is disposed at a central portion in the vertical direction of the bottom surface of the first peripheral groove 21. On the bottom surface of the first peripheral groove 21, a size in the vertical direction of each of a portion 21*b* (hereinafter referred to as an upper groove portion) positioned above the ridge portion 23 and a portion 21*c* (hereinafter referred to as a lower groove portion) positioned below the ridge portion 23 is equal to a size in the vertical direction of the ridge portion 23. The upper groove portion 21*b* and the lower groove portion 21*c* are each formed in a curved shape recessed inward in the radial direction.

An end portion in the circumferential direction of the ridge portion 23 is connected to the peripheral end surface 21*a* of the first peripheral groove 21. Further, a gap in the circumferential direction may be provided between the end portion in the circumferential direction of the ridge portion 23 and the peripheral end surface 21*a* of the first peripheral groove 21. The ridge portion 23 is positioned radially inward from the outer peripheral surfaces of the panel surface portions 15 and 16. Radial positions of an outer end portion in the radial direction of the ridge portion 23 and an opening peripheral edge portion of the first peripheral groove 21 on the inner surface of the second peripheral groove 22 are the same as each other. The ridge portion 23 is formed in a curved surface shape protruding toward the outside in the radial direction. Further, a shape in a longitudinal sectional view in the vertical direction of the ridge portion 23 may be changed as appropriate such as to a trapezoidal shape in a lateral direction.

As described above, according to the square bottle 1 according to the present embodiment, since the ridge portion 23 straddling the corner portions 17 in the circumferential direction is formed on the inner surface of the first peripheral groove 21, a rigidity of the corner portions 17 can be increased and thus deformation of the body portion 13 such as internal angles of the corner portions 17 changing at the time of pressure reduction in the square bottle 1 can be inhibited even when the body portion 13 is made thin.

Also, since the first peripheral groove 21 is formed on the inner surface of the second peripheral groove 22 formed in the body portion 13, a rigidity of the entire body portion 13 is increased, and deformation of the body portion 13 at the time of pressure reduction in the square bottle 1 can be reliably inhibited even when the body portion 13 is made thin.

Also, although the body portion 13 has a rectangular shape in a cross-sectional view perpendicular to the bottle axis O and the body portion 13 is likely to be deformed in such a manner that internal angles of the two corner portions 17 facing each other in the radial direction are widened and the remaining two corner portions 17 are pointed at the time of pressure reduction in the square bottle 1, since deformation of the body portion 13 can be inhibited due to the ridge portion 23 formed on the inner surface of the first peripheral groove 21, remarkable operation and effects are achieved.

Also, since the ridge portion 23 is disposed to integrally straddle the panel surface portion 16 on the short side and the corner portions 17 which are continuous with both the end portions 18 in the circumferential direction of the panel surface portion 16 in the circumferential direction, the rigidity of the corner portions 17 is effectively increased, and deformation of the body portion 13 at the time of pressure reduction in the square bottle 1 can be reliably inhibited.

Also, since the ridge portion 23 is disposed to avoid the central portion 19 in the circumferential direction of the panel surface portion 15 on the long side, when the panel surface portion 15 on the long side is gripped in order to lift the square bottle 1, the ridge portion 23 can be prevented from being obstacle due to it being touched with fingers.

The present invention is not limited to the above-described embodiment and can be appropriately modified within the scope not deviating from the gist of the present invention.

For example, in the above-described embodiment, the first peripheral groove 21 is formed on the inner surface of the second peripheral groove 22, but the first peripheral groove 21 may be formed directly on the outer peripheral surfaces of the panel surface portions 15 and 16 without forming the second peripheral groove 22 in the body portion 13.

Also, in the body portion 13, the ridge portion 23, the first peripheral groove 21, and the second peripheral groove 22 may be disposed only at respective portions straddling the corner portion 17 in the circumferential direction.

Further, the ridge portion 23 and the first peripheral groove 21 may be caused to extend continuously over the entire circumference.

Also, in the above-described embodiment, although the ridge portion 23 is formed on the bottom surface in the inner surface of the first peripheral groove 21, the ridge portion 23 may be formed on the upper surface or the lower surface, or may be formed to straddle the upper surface, the lower surface, and the bottom surface.

Further, a shape in a longitudinal sectional view in the vertical direction of the first peripheral groove 21 may be changed as appropriate such as to a trapezoidal shape in a lateral direction or in a curved shape recessed inward in the radial direction. Also in the latter case, the inner surface of the first peripheral groove 21 includes an upper surface, a lower surface, and a bottom surface, of which the bottom surface is a portion of the inner surface of the first peripheral groove 21 positioned furthest inward in the radial direction.

Also, in the above-described embodiment, although a shape of each of the shoulder portion 12, the body portion 13 and the bottom portion 14 in a cross-sectional view perpendicular to the bottle axis O is rectangular, the present invention is not limited thereto and may be changed as appropriate such as, for example, to a triangular shape, a square shape, or a pentagonal shape.

Also, a synthetic resin material forming the square bottle 1 may be appropriately changed such as, for example, to polyethylene terephthalate, polyethylene naphthalate, amorphous polyester, or a blended material thereof.

Further, the square bottle 1 is not limited to a single layer structure and may be a laminated structure having an intermediate layer. As the intermediate layer, a layer made of a resin material having gas barrier properties, a layer made of a recycled material, a layer made of a resin material having oxygen absorbing ability, or the like are exemplary examples.

In addition, the components in the above-described embodiments can be appropriately replaced with well-known components without departing from the spirit and scope of the present invention, and furthermore, the above-described modified examples may be appropriately combined.

While preferred embodiments of the invention have been described and shown above, it should be understood that these are exemplary examples of the invention and are not to be considered as limiting. Additions, omissions, substitutions, and other modifications can be made without departing from the spirit or scope of the present invention. Accordingly, the invention is not to be considered as being limited by the foregoing description and is only limited by the scope of the appended claims.

What is claimed is:

1. A polygon bottle comprising a mouth portion, a shoulder portion, a body portion, and a bottom portion provided to be continuous in this order from a top to a bottom in a bottle axis direction, wherein in the body portion, a plurality of panel surface portions are provided to be continuous with each other with corner portions therebetween in a circumferential direction around a bottle axis, in the body portion, a first peripheral groove straddling at least the corner portions in the circumferential direction is formed, the body portion has a polygon shape in a cross-sectional view perpendicular to the bottle axis, a ridge straddling the corner portions in the circumferential direction is formed on an inner surface defining the first peripheral groove, in a side view, the ridge is surrounded by the inner surface defining the first peripheral groove over an entire circumference of an outer peripheral edge of the ridge, an outer end of the ridge in a radial direction intersecting the bottle axis direction is positioned inward from outer peripheral surfaces of the plurality of the panel surface portions in the radial direction, the inner surface defining the first peripheral groove includes a peripheral end surface positioned at an outer end portion in the circumferential direction and facing inward in the circumferential direction, the peripheral end surface is inclined to gradually approach an inside in the circumferential direction of the first peripheral groove from an outer end edge in the circumferential direction of the first peripheral groove as the peripheral end surface approaches an inside from an outside in the radial direction, an end portion in the circumferential direction of the ridge is connected to the peripheral end surface, and the outer end edge in the circumferential direction of the first peripheral groove gradually extends toward the outside in the radial direction as the outer end edge goes downward.

2. The polygon bottle according to claim 1, wherein a second peripheral groove straddling at least the corner portions in the circumferential direction is formed in the body portion, and the first peripheral groove is formed on an inner surface defining the second peripheral groove.

3. The polygon bottle according to claim 1, wherein the body portion has a rectangular shape in the cross-sectional view perpendicular to the bottle axis, and in the body portion, the panel surface portion on a long side and the panel surface portion on a short side are provided to be continuous with each other via the corner portion.

4. The polygon bottle according to claim 3, wherein the ridge is disposed to integrally straddle the panel surface portion on the short side and the corner portions which are continuous with both end portions in the circumferential direction of the panel surface portion on the short side in the circumferential direction, and the ridge is disposed to avoid a central portion in the circumferential direction of the panel surface portion on the long side.

5. The polygon bottle according to claim 2, wherein the body portion has a rectangular shape in the cross-sectional view perpendicular to the bottle axis, and in the body portion, the panel surface portion on a long side and the panel surface portion on a short side are provided to be continuous with each other via the corner portion.

6. The polygon bottle according to claim 5, wherein the ridge is disposed to integrally straddle the panel surface portion on the short side and the corner portions which are continuous with both end portions in the circumferential direction of the panel surface portion on the short side in the circumferential direction, and the ridge is disposed to avoid a central portion in the circumferential direction of the panel surface portion on the long side.

* * * * *